US006116161A

United States Patent [19]

Voge et al.

[11] Patent Number: 6,116,161

[45] Date of Patent: Sep. 12, 2000

[54] METHOD AND DEVICE FOR CLEANING AN INKING SYSTEM OF A PRINTING MACHINE

[75] Inventors: Michael Voge, Malsch; Carsten Kelm, Mannheim, both of Germany

[73] Assignee: Heidelberger Druckmaschinen Aktiengesellschaft, Heidelberg, Germany

[21] Appl. No.: 09/033,523

[22] Filed: Mar. 2, 1998

[30] Foreign Application Priority Data

Mar. 1, 1997 [DE] Germany ..... 197 08 435

[51] Int. Cl.[7] ..... B41C 1/06

[52] U.S. Cl. ..... 101/483; 101/423

[58] Field of Search ..... 101/483, 423, 101/424, 425, 349.1–353, DIG. 32; 15/256.52, 256.51, 256.5

[56] References Cited

U.S. PATENT DOCUMENTS

| | | | |
|---|---|---|---|
| 3,651,758 | 3/1972 | Harrod | 101/350 |
| 3,701,316 | 10/1972 | Sylvester et al. | 101/425 |
| 5,010,820 | 4/1991 | Loffler | 101/484 |
| 5,178,066 | 1/1993 | Guaraldi et al. | 101/DIG. 32 |
| 5,213,044 | 5/1993 | Elia et al. | 101/425 |
| 5,388,514 | 2/1995 | Eltner | 101/483 |
| 5,447,102 | 9/1995 | Pfeiffer et al. | 101/492 |
| 5,452,660 | 9/1995 | Stein | 101/425 |
| 5,842,416 | 12/1998 | Olawsky et al. | 101/350.1 |

FOREIGN PATENT DOCUMENTS

| | | |
|---|---|---|
| 0 722 834 | 12/1995 | European Pat. Off. . |
| 1 561 100 | 2/1970 | Germany . |
| 37 07 695 C2 | 1/1991 | Germany . |
| 2 299 300 | 10/1988 | United Kingdom . |

*Primary Examiner*—John S. Hilten
*Assistant Examiner*—Anthony H. Nguyen
*Attorney, Agent, or Firm*—Kenyon & Kenyon

[57] ABSTRACT

A method and devices for cleaning an inking system of a printing machine in which a further drive of the inking system (1) is used for the reverse transport of the ink into the ink fountain (4), while the clock-pulse movement of vibrator roller (5) between ductor roller (6) and distributor roller (7) continues to take place, and that only after this reverse transport of the ink is the customary cleaning of the inking system (1) carried out.

7 Claims, 1 Drawing Sheet

METHOD AND DEVICE FOR CLEANING AN INKING SYSTEM OF A PRINTING MACHINE

FIELD OF THE INVENTION

The present invention relates to a method for cleaning an inking system of a printing machine, the ink-metering elements of the ink zones of the ink fountain being closed, and a further drive of the printing machine taking place. Furthermore, the present invention relates to devices for implementing the method with an inking system which has an ink fountain, ink-metering elements, a vibrator roller, a ductor roller, a distributor roller, intermediate rollers and plate inking rollers.

RELATED TECHNOLOGY

Inking systems of printing machines must be cleaned when taken out of service or when changing ink. Up to now, the ink-metering elements were closed, the clock pulse of the vibrator roller was switched off, and then waste sheets were printed until the greatest part of the ink was removed from the inking system. Subsequently, the residual ink was removed by a washing operation. The disadvantage of this method was that the ink located in the inking system had to be completely disposed of as waste material. This was carried out partially by the large number of imprinted waste sheets, partially by the ink dissipated in the washing solution. In addition, this type of clean-up took a great deal of time, which increased the machine downtime and thus reduced productivity.

SUMMARY OF THE INVENTION

An object underlying the present invention is to make available a method and devices for cleaning an inking system of a printing machine which make it possible to clean the inking system in a shorter time with less ink waste material.

The present invention therefore provides that a further drive of the inking system is used for the reverse transport of the ink into the ink fountain, while the clock-pulse movement of the vibrator roller between the ductor roller and distributor roller continues to take place, and that only after this reverse transport of the ink is the customary cleaning (such as washing) of the inking system carried out. In the case of the suitable refinements of the present method, reference is made to the devices for its implementation.

The present invention is thus supported by the fact that closed ink-metering elements wipe off ink from the ductor roller, and therefore, by continuing the clock pulse of the vibrator roller, it is possible to transport ink from the inking system back into the ink fountain. Since the thickness of the ink layer is greatest on the ductor roller, the vibrator roller and the distributor roller, and then decreases by approximately half at each transfer to another roller due to ink splitting, the greatest portion of the ink is in the upper area of the inking system. Because of that, this greatest portion of the ink located in the inking system can be transported back into the ink fountain through the method according to the present invention. This also proceeds more quickly than misprinting the ink on waste sheets, during which said ink must pass through the entire inking system.

The ink transported back into the ink fountain reduces ink waste and can be reused. During an ink change, the attendant returns the ink from the ink fountain into the supply tank again. Due to the method according to the present invention, fewer waste sheets have to be misprinted less washing solution is needed, and the clean-up is less time-consuming. This reduction in waste material, which must be disposed of as separate refuse is an important requirement today for ecological reasons. The particular advantage of the present invention is that this requirement is not only met, but greater economic efficiency is attained at the same time. Another advantage is that less ink is delivered into doctor-blade housings which are used to remove excess ink from a printing unit. Given the reverse transport of the ink according to the present invention the emptying and monitoring of these doctor-blade housings takes up less time.

A considerable acceleration of the cleaning process is attained by driving the ductor roller and the clock pulse of the vibrator roller more quickly than the printing machine. In this manner, the greatest portion of the ink in the inking system is transported back into the ink fountain within the briefest period of time.

Used to carry out the present method is a device with an inking system which has an ink fountain, ink-metering elements, a vibrator roller, a ductor roller, a distributor roller, intermediate rollers and plate inking rollers, characterized in that the ductor roller and the clock pulse of the vibrator roller are driven independently of the main drive of the printing machine. This allows an acceleration of the reverse transport of the ink due to a faster drive.

An expedient further development of the present method provides for driving the ductor roller slowly for a brief time before the reverse transport of the ink terminates. The knowledge underlying this further development is that, even given closed ink-metering elements, a slight deflection away of the ink fountain and the ductor roller occurs due to the hydrodynamic pressure of the ink, which results in a certain application of ink film, even though the ink-metering elements are closed. This ink application is a function of the speed, since the hydrodynamic pressure is increased in response to great rotational speed of the ductor roller, as a result of which the ink fountain and the ductor roller deflect more away and a greater ink film is applied. Thus, if an optimal ink-cleaning of the ductor roller is to be carried out, it is expedient that before the reverse transport of the ink is terminated and after the rollers have been driven at the speed of or especially at even a greater speed of the printing machine, the ductor roller is driven slowly to better clean it. Thus, for example, the present method looks like this: that the machine runs at 6,000 revolutions, however the ductor roller runs analogously at 15,000 revolutions, and the vibrator roller also runs with the corresponding faster frequency. Thereupon, to better clean it, the ductor roller moves at a kind of crawl speed, in that, for instance, it slowly makes two revolutions in order to remove to the greatest extent possible the quantity of ink residue caused by the hydrodynamic pressure of the fast revolutions. These slow revolutions can take place with the vibrator roller switched on or off, or the vibrator roller is first switched on during the slow revolutions and then switched off. The present method is realized by a device in which the clock pulse of the vibrator roller is able to be switched off and the ductor roller continues to be drivable. This can be effected by allocating a separately controllable drive to the ductor roller and to the vibrator roller, respectively.

Another refinement of the present method provides that, before a reverse transport of the ink, a separation is effected of the ink transfer between the rollers having a great ink-layer thickness and the rollers with slight ink-layer thickness. As already explained, the thickness of the ink layer decreases by approximately half with each ink splitting. Thus, the more ink splittings there are between the ink fountain and a roller, the less thick is the ink layer of this roller. In addition, the retransfer of the ink into the ink fountain is more difficult and lasts longer, the more ink splittings take place between a roller and the ink fountain. Therefore, it can be useful, by such a separation of rollers, to provide a reverse transport of the ink only for the rollers which have a great ink-layer thickness. In this context, it is also often the case that, given a plurality of plate inking rollers, they can have layer thicknesses which vary widely—because of the different number of ink splittings between the ink fountain and the respective plate inking roller—so that a portion of the plate inking rollers, together with the intermediate rollers allocated directly to them, can be isolated from the remaining inking system. The aim in so doing is to carry out a reverse transport of the ink only in the case of rollers with a great layer thickness.

However, another type of separation is also possible. A further development of the present method provides for such a separation, which is characterized in that, before a reverse transport of the ink, a separation is effected of the ink transfer between the rollers which lie closer to the ink fountain and the rollers which lie closer to the plate cylinder. This method is particularly suitable when, during the reverse transport of the ink, the slight ink-layer thicknesses on the plate inking rollers and a portion of the intermediate rollers are to be removed by printing on waste sheets. In this manner the thick ink layers, which are not very far away from the ink fountain, are transported back into the ink fountain, and at the same time, the thinner ink layers of the rollers lying far away from the ink fountain can be misprinted on waste sheets. In this manner, a relatively quick and thorough pre-cleaning of the inking system is carried out, during which the ink residues are already removed so well that a great deal of washing fluid is no longer necessary during washing.

A further acceleration of the reverse transport of the ink into the ink fountain can be attained by driving the rollers lying closer to the ink fountain faster than the printing machine.

However, in addition to the reverse transport of the ink, the possibility of course exists in the case of all the refinements of the present method to print residual ink on waste sheets, and only then to carry out a washing operation for the complete clean-up.

The device for cleaning an inking system of a printing machine can be designed in such a way for implementing a method for cleaning an inking system (1) of a printing machine (2) while ink-metering elements (3) of the ink zones of ink fountain (4) are closed and a further drive of the printing machine is run, characterized in that a separate drive of the inking system (1) is used to transport the ink back into the ink fountain (4), while the clock-pulse movement of vibrator roller (5) between ductor roller (6) and distributor roller (7) continues to take place, and that only after this reverse transport of the ink is the customary cleaning of the inking system (1) carried out, and further characterized in that the ductor roller (6) and the clock pulse of the vibrator roller (5) are driven faster than the printing machine. As such the ductor roller and the clock pulse of the vibrator roller are driven independently of the main drive of the printing machine. Thus, the ductor-roller drive and the drive for the clock pulse of the vibrator roller are not integrated into the closed gear train of the main drive of the printing machine, but rather are arranged separately and thereby are separately controllable. In this context, it is expedient if a separately controllable drive is allocated in each case to the ductor roller and to the vibrator roller. In this manner, it is possible to allow for a faster speed of the ductor roller at first, and at the termination of the reverse transport of the ink, to switch off the clock pulse of the vibrator roller, and still to have a slow speed of the ductor roller follow for a short time. In addition, the separately controllable drives allow an adjustment of the speed to the respective conditions, such as the consistency of the ink.

A device for implementing the above method which is further characterized in that, before a reverse transport of the ink, a separation is effected of the ink transfer between rollers (7 to 13, 18, 19) with great ink-layer thickness and rollers (16, 17, 20, 21) with slight ink-layer thickness is also provided. The device provides for at least one disengageable intermediate roller located between the rollers having a great ink-layer thickness and the rollers having slight ink-layer thickness for separating the ink transfer. Using the at least one disengageable intermediate roller, a complete separation is achieved, with the purpose of transporting only the ink of the rollers having a great ink-layer thickness back to the ink fountain.

To implement a method in which, before a reverse transport of the ink, a separation is effected of the ink transfer between the rollers (7,8,9,10) lying closer to the ink fountain (4) and the rollers (12 to 21) lying closer to plate cylinder (22), a device is provided in which, for the separation of the ink transfer, at least one disengageable intermediate roller is located between the rollers lying closer to the ink fountain and the rollers lying closer to the plate cylinder. A complete separation takes place within the inking system here, as well, with the purpose of transporting back to the ink fountain only the ink layers of greater thickness. The lesser ink-layer thicknesses can be misprinted on waste sheets or washed off directly. This device can be designed in such a way that the rollers lying closer to the ink fountain are driven independently of the main drive of the printing machine. The rollers lying closer to the ink fountain have a greater ink-layer thickness which can be removed more quickly by the separate drive with the assistance of a higher speed.

BRIEF DESCRIPTION OF THE DRAWING

The present invention is clarified with the aid of the drawing in which.

DETAILED DESCRIPTION

Figure 1:
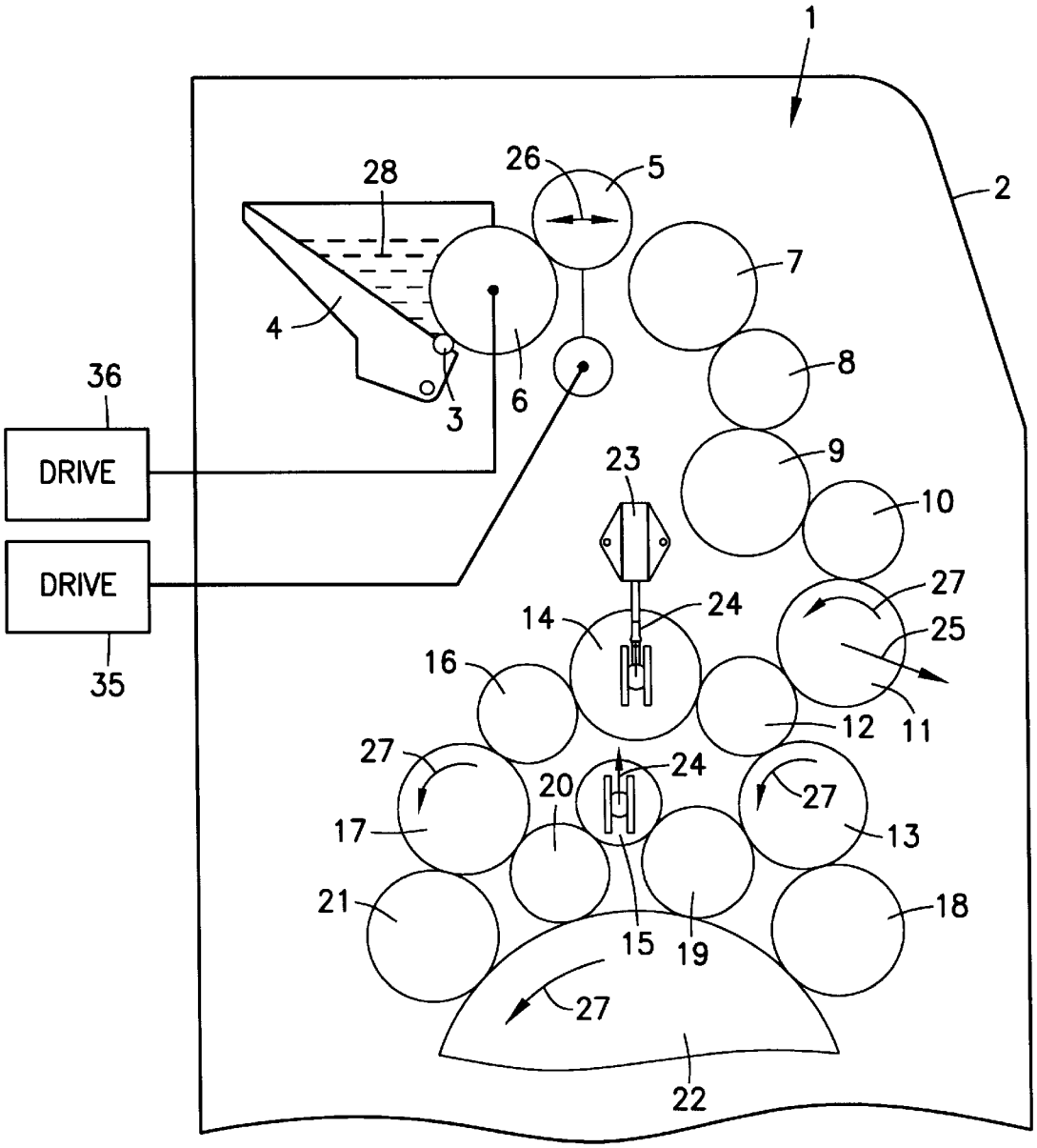
FIG. 1. shows a portion of a printing unit having an embodiment of the present invention.

FIG. 1 shows a portion of a printing unit of a printing machine 2 which contains an inking system 1. Inking system 1 is comprised of an ink fountain 4 filled with ink 28, as well as ink-metering elements 3 which can be constructed as cams or blades. The thickness with which the ink layer is applied on ductor roller 6 is determined by the adjustment of ink-metering elements 3. The ink is removed from ductor roller 6 using a vibrator roller 5 and is transferred onto distributor roller 7. From there, the ink, by way of intermediate rollers 8–17, reaches plate inking rollers 18–21 which, during printing, apply the ink to plate cylinder 22 which passes it along to the blanket cylinder that prints the ink onto sheets.

The subject matter of the present invention is the cleaning of inking system 1. According to the related art (which would not contain all the elements shown in FIG. 1 or be in the same configuration as FIG. 1), ink-metering elements 3 were closed, vibrator roller 5 was switched off, and the residual ink located in inking system 1 was printed on waste sheets. The residual ink not removable in this manner was then eliminated by means of a washing operation.

According to the present invention, ink-metering elements 3 are closed, however vibrator roller 5 continues to be operated in its clock pulse and the ductor roller likewise continues to be driven. In this context, double arrow 26 shows how the ink is transferred between ductor roller 6 and distributor roller 7 using the clock pulse. To clean the inking system, the ink transfer is now carried out in reverse direction, the ink transferred back onto ductor roller 6 being wiped off by closed ink-metering elements 3 and, in this manner, being conveyed back into ink fountain 4. Intermediate rollers 8, 9 and 10 adjacent to distributor roller 7 have the greatest ink application, and the intermediate rollers adjacent to intermediate rollers 8, 9 and 10 have all the less ink application, as there has been a greater number of ink transfers. This fact is utilized by the present invention to the effect that the greatest ink layers have the smallest reverse transfer path to the ink fountain. For this reason, the reverse transfer is simpler than misprinting the residue ink on waste sheets. The process according to the present invention can be accelerated by the clock pulse of vibrator roller 5 and the revolutions of ductor roller 6 taking place faster than the drive of the printing machine. For this purpose, vibrator roller 5 and ductor roller 6 are equipped with respective separate drives 35, 36 (shown schematically).

Since the reverse transfer is advisable primarily with regard to the rollers which have a great ink-layer thickness, one or a plurality of the intermediate rollers can be designed in a manner that they are disengageable. In this manner, the ink transfer is interrupted at this location. For example, intermediate rollers 16 and 17, as well as plate inking rollers 20 and 21 are coupled to ink fountain 4 via many ink transfers. They have a very slight ink-layer thickness, and the ink would have to be conveyed back via many rollers. For this reason, it can be advisable to provide disengageable intermediate rollers 14 and 15, to thus split inking system 1. To this end, adjusting devices are provided, of which one adjusting device 23 is shown. Arrows 24 show the disengaging movement of intermediate rollers 14 and 15. However, another separation can also be provided, in that intermediate roller 11 is disengageable in corresponding manner as shown by arrow 25. Given this measure, it is also possible to drive distributor roller 7 and intermediate rollers 8, 9 and 10 faster to accelerate the reverse conveyance of the ink. The slight ink-layer thicknesses of the remaining rollers then take the same path as during printing; they are transferred onto plate cylinder 22 which passes on the ink to a blanket cylinder that prints it on the waste sheets. Arrows 27 indicate just the direction of rotation of several of the rollers.

Achieved with these measures is that the greatest portion of the ink is conveyed back into the ink fountain, and only a small portion has to be printed on waste sheets and washed off.

What is claimed is:

1. A method for cleaning an inking system of a printing machine having ink-metering elements of an ink fountain, a ductor roller adjacent the ink fountain and a distributor roller connected to the ductor roller by a vibrator roller, the method comprising the steps of:

closing the ink-metering elements;

disengaging intermediate rollers of the printing machine, to interrupt ink transfer between first rollers carrying at least a certain ink-layer thickness and second rollers carrying less than the certain ink-layer thickness, the first rollers remaining in connection with the distributor roller;

reversing transport of ink from the first rollers back to the ink fountain using a drive of the inking system;

performing a clock-pulse movement of the vibrator roller between the ductor roller and the distributor roller of the inking system to transport ink from the distributor roller to the ductor roller and to the ink fountain; and further cleaning the inking system by removing ink from at least one of the ductor roller, the vibrator roller, the distributor roller and the intermediate rollers.

2. The method as recited in claim 1 wherein during the reverse-transporting step, the ductor roller and the clock pulse movement of the vibrator roller are driven faster than the printing machine by an additional drive.

3. The method as recited in claim 1 wherein before the reverse-transporting step terminates, the ductor roller is driven slowly for a brief time.

4. The method as recited in claim 1 wherein during the reverse-transporting step the drive is driven independently of a main drive of the printing machine.

5. The method as recited in claim 1 further comprising the step of effecting a separation of ink transfer between rollers lying closer to the ink fountain and rollers lying closer to a plate cylinder, the effecting step taking place before the reverse-transporting step.

6. The method as recited in claim 5 wherein during the reverse-transporting step the rollers lying closer to the ink fountain are driven faster than the printing machine by an additional drive.

7. The method as recited in claim 1 wherein the cleaning step includes printing residual ink on waste sheets and a washing operation.

* * * * *